US011535439B2

(12) United States Patent
Truitt et al.

(10) Patent No.: US 11,535,439 B2
(45) Date of Patent: Dec. 27, 2022

(54) PASTEURIZATION POUCH WITH BARRIER

(71) Applicant: SONOCO DEVELOPMENT, INC., Hartsville, SC (US)

(72) Inventors: Mary Katherine Truitt, Hartsville, SC (US); Donald Gregory Taylor, Hartsville, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 521 days.

(21) Appl. No.: 16/657,484

(22) Filed: Oct. 18, 2019

(65) Prior Publication Data

US 2021/0114790 A1 Apr. 22, 2021

(51) Int. Cl.

| | |
|---|---|
| ***B65D 75/20*** | (2006.01) |
| ***B65D 65/10*** | (2006.01) |
| ***B65D 65/42*** | (2006.01) |
| ***B65D 85/72*** | (2006.01) |
| ***B65B 55/02*** | (2006.01) |
| ***B65B 25/00*** | (2006.01) |
| ***B65B 51/10*** | (2006.01) |

(52) U.S. Cl.

CPC ..... *B65D 75/20* (2013.01); *B65B 25/001* (2013.01); *B65B 51/10* (2013.01); *B65B 55/02* (2013.01); *B65D 65/10* (2013.01); *B65D 65/42* (2013.01); *B65D 85/72* (2013.01)

(58) Field of Classification Search

CPC ..... B65B 25/00; B65B 25/001; B65B 55/02; B65D 65/10; B65D 65/42; B65D 75/20; B65D 85/72; F17C 13/00

USPC ..... 206/484–484.2

See application file for complete search history.

(56) References Cited

U.S. PATENT DOCUMENTS

| | | | | |
|---|---|---|---|---|
| 5,645,161 | A * | 7/1997 | Whitaker | B01J 13/02 206/484 |
| 5,928,748 | A * | 7/1999 | Jones | B32B 3/04 428/40.1 |
| 6,364,097 | B1 * | 4/2002 | Whitaker | A45D 40/0087 206/484 |
| 6,530,477 | B1 * | 3/2003 | Martorano | B32B 15/08 206/484.2 |

(Continued)

FOREIGN PATENT DOCUMENTS

| | | |
|---|---|---|
| CN | 206231801 | 6/2017 |
| JP | 3156541 | 1/2010 |

(Continued)

*Primary Examiner* — Bryon P Gehman

(74) *Attorney, Agent, or Firm* — Nelson Mullins Riley & Scarborough LLP

(57) ABSTRACT

A package comprising a first panel defining a first end, a second end opposite the first end, and at least two side edges; a second panel defining a first end, a second end opposite the first end, and at least two side edges, wherein the second panel is connected to the first panel via longitudinal seams formed along respective side edges of the first and second panels; and at least one end seam formed along at least one of the first end or the second end of the first and second panels, wherein the at least one end seam comprises an outer edge; and a barrier coating disposed on an interior surface of at least one of the first and second panels, wherein the barrier coating does not extend to the side edges of the longitudinal seams or the outer edge of the at least one end seam.

14 Claims, 3 Drawing Sheets

(56) References Cited

U.S. PATENT DOCUMENTS

| | | | | |
|---|---|---|---|---|
| 9,155,668 | B2 * | 10/2015 | Dahl | A61F 13/15747 |
| 10,017,309 | B2 * | 7/2018 | Dahlqvist | B65D 75/20 |
| 10,800,148 | B2 * | 10/2020 | Savargaonkar | B65D 75/008 |
| 2003/0031763 | A1 | 2/2003 | Inagaki et al. | |
| 2004/0023054 | A1 | 2/2004 | Wolak | |
| 2015/0284168 | A1 | 10/2015 | Cohn | |

FOREIGN PATENT DOCUMENTS

| | | | |
|---|---|---|---|
| JP | 4518597 | B2 | 8/2010 |
| JP | 3169015 | | 7/2011 |
| JP | 2018062660 | A | 4/2018 |
| KR | 20140029258 | A | 3/2014 |

* cited by examiner

PASTEURIZATION POUCH WITH BARRIER

FIELD OF THE INVENTION

The present disclosure relates in general to packaging for food products, and more particularly to flexible bags and pouches which comprise a barrier layer and can be pasteurized, hot filled, boiled, retorted, and/or the like.

BACKGROUND

Flexible materials, such as polymers and flexible films, are often used to construct packages for food products, such as bags and pouches. Such packages can be used to hold a variety of items, such as yogurt, apple sauce, pudding, baby food, and many other foods. The food packages may be single-serve packages or may be multi-use packages. In some cases, the type of food product contained in the package must be filled into the package while hot and/or the packaging must be pasteurized, retorted or boiled after the food product has been filled into the package and the package has been sealed closed.

Commercially available barrier coatings cannot survive pasteurization or similar heat/moisture exposure. If a barrier coating is disposed within the seal areas of a packaging structure, the coating breaks down during pasteurization, causing the packaging structure to partially or fully delaminate and ruining the product contained therein. Currently, barrier coatings are simply not used in packages which require pasteurization or similar heat/moisture processing.

In some cases, certain barrier qualities may be achieved in packaging structures which require pasteurization via various combinations of films or polymer additives. However, the use of dissimilar films and additives is disadvantageous to recycling processes, as multi-polymer films may not be recycled in a single stream recycling process.

BRIEF SUMMARY

Embodiments of the invention described herein provide improved packages and methods for constructing packages through the use of pattern-applied barrier coatings or specifically constructed layers in a mono-polymeric flexible package. By pattern applying the barrier coating in a specific pattern and/or providing a separate layer which is not disposed in at least the cut edge interface and, further, which may not be disposed in the heat seal region at all, the barrier coating is protected from being exposed to moisture in a hot water bath. Said alternatively, the packaging structure of the invention is barrier-free in the cut edge interface and/or heat seal areas. This allows the packaging structure to survive high heat and moisture exposure during pasteurization and the like without comprising the integrity of the barrier coating. The inventive packaging structure may be used for hot fill applications, boiling applications, pasteurization, retort, and the like. A mono-polymer film can be used in the invention, allowing recyclability in a single resin stream.

Accordingly, in an embodiment, the invention comprises a package comprising a first panel defining a first end, a second end opposite the first end, and at least two side edges; a second panel defining a first end, a second end opposite the first end, and at least two side edges, wherein the second panel is connected to the first panel via longitudinal seams formed along respective side edges of the first and second panels; and at least one end seam formed along at least one of the first end or the second end of the first and second panels, wherein the at least one end seam comprises an outer edge; and a barrier coating disposed on an interior surface of at least one of the first and second panels, wherein the barrier coating does not extend to the side edges of the longitudinal seams or the outer edge of the at least one end seam.

In another embodiment, the invention comprises a package comprising a first panel defining a first end, a second end opposite the first end, and at least two side edges and a second panel defining a first end, a second end opposite the first end, and at least two side edges. The second panel is connected to the first panel via longitudinal seams formed along respective side edges of the first and second panels and at least one end seam formed along at least one of the first end or the second end of the first and second panels, wherein the at least one end seam comprises an outer edge. A barrier coating disposed on an interior surface of at least one of the first and second panels, wherein the package is barrier-free adjacent at least the side edges of the longitudinal seams and the outer edge of the at least one end seam.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 1:
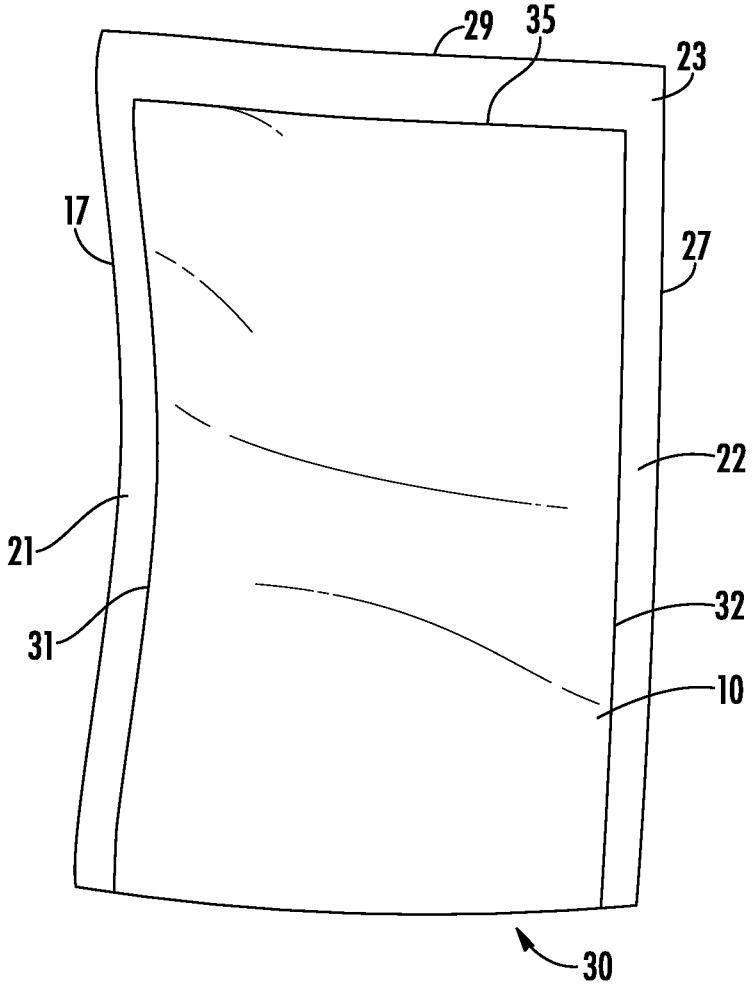
FIG. 1 is a perspective view of a package in an embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Accordingly, in some embodiments, a package is provided that includes a front panel and a rear panel. The front and rear panel may comprise a single panel which is folded over itself, in an embodiment. The folded edge of the front and rear panel may comprise a top or bottom of the packaging. The side edges and the edge which is opposite the folded edge, in this embodiment, may each be heat sealed closed. As used herein, "heat sealing" is contemplated to include direct application of heat, for example, with resistance heaters; heat application through ultrasonic waves; and other methods of producing heat. However, one skilled in the art will understand that the invention is not limited to heat activated adhesives and that the heat activated adhesives described herein are not limiting.

In one embodiment, a package is provided wherein the package comprises a front panel defining a first end, a second end, and two side edges, as well as a back panel defining a first end, a second end, and two side edges. In another embodiment, a package is provided wherein the package comprises a front panel defining a top end, a bottom end, and two side edges, as well as a back panel defining a top end, a base end, and two side edges. The back panel is connected to the front panel via longitudinal seams formed along respective side edges of the front and back panels. The first or top end of the front panel and the first or top end of the back panel may, in some embodiments, define an opening of the package that is configured to provide access to contents of the package when the package is opened by a user.

In some embodiments, the pouch may be a stand-up pouch, fitment pouch, envelope pouch, pillow pack, bag, gusseted pouch, or any other package that includes front and back panels joined by at least one seam. In an embodiment, the package may include a front and back panel joined by three, four, or more seams. In an embodiment, the seams are heat sealed.

In an embodiment, the pouch may contain food or beverage products, such as apple sauce, yogurt, frozen fruits or vegetables, juice, milk, or pet food. Any product that would benefit from a hot fill application, pasteurization, boiling, or retort procedure is contemplated herein.

As depicted in the figures, the inventive packages may, for example, have a front panel 10 and a back panel 20 that are joined to each other along respective side edges 17, 27 of the panels (for example, via heat sealing) to create longitudinal seams 21, 22. In some embodiments, the longitudinal seams 21, 22 and/or any other seams discussed herein may comprise lock seals or weld seals. In an embodiment, the seams discussed herein may not be separatable without destruction of the packaging materials.

In some cases, one end of the package, for example, the bottom end, may comprise a fold 30 between the front panel 10 and back panel 20. In this embodiment, the front panel 10 and back panel 20 are joined to each other without the use of an additional base panel. In addition to the longitudinal seams 21, 22, the front panel 10 and back panel 20 may be additionally joined to each other along the top edges of the panels 15, 25 (e.g., via heat sealing) to create top seam 23.

In an embodiment, the inventive package comprises a barrier material 50. In an embodiment, the barrier material 50 comprises a coating or a separate layer. In an embodiment, the barrier material prevents or impedes the migration of moisture, water vapor, oxygen, and/or gases into or out of the packaging. In an embodiment, the barrier material 50 comprises polyvinyl alcohol (PVOH), but any barrier material known in the art may be utilized. In an embodiment, the barrier material 50 comprises nanoparticles or nanoplatelets.

Figure 2:
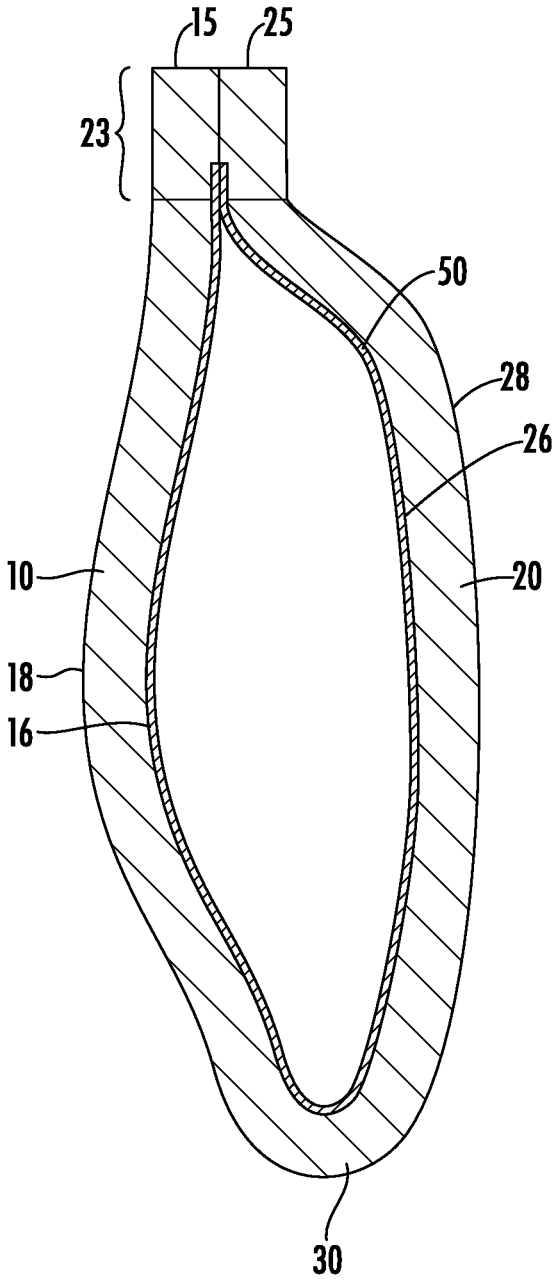
FIG. 2 is a cross-sectional view of a package in an embodiment of the invention.
Figure 3:
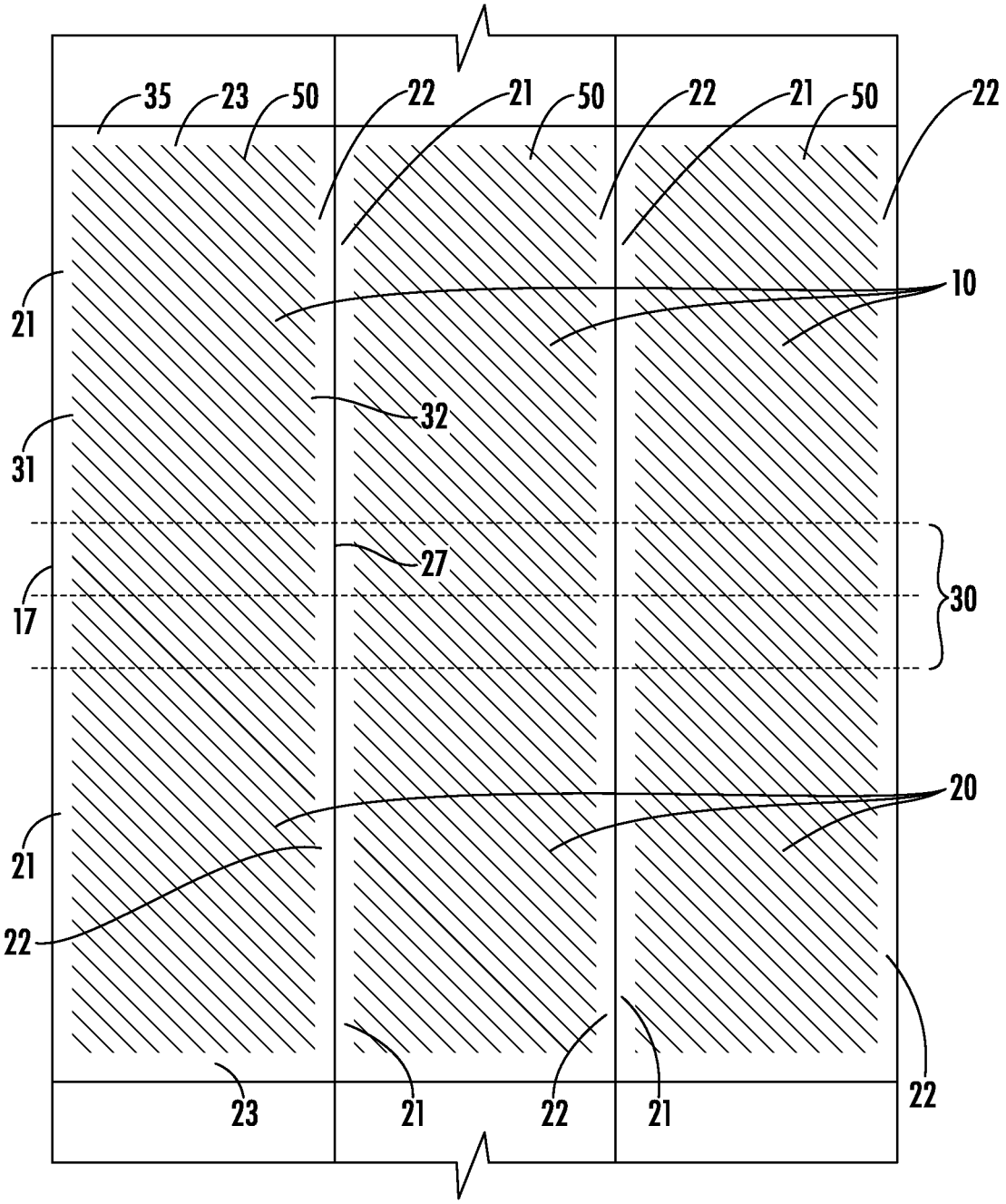
FIG. 3 is a top view of a blank used to form packages in an embodiment of the invention.

In an embodiment shown in FIG. 2, the front panel 10 comprises an inner surface 16 and an outer surface 18. In an embodiment, the rear panel 20 comprises an inner surface 26 and an outer surface 28. In an embodiment, the barrier material 50 is applied to at least one of the inner surfaces 16, 26 of the panels 10, 20. In an embodiment, the barrier material 50 is disposed on both inner surfaces 16, 26 of the panels 10, 20. In an embodiment, the barrier material 50 is disposed within the fold 30.

In an embodiment, the barrier material 50 is not disposed within the seams 21, 22, 23. That is, the barrier material 50 may be disposed throughout the interior of the packaging structure, but may, for example, terminate at or adjacent the inside edge 31, 32 of the longitudinal seams 21, 22. Likewise, the barrier material 50 may terminate at or adjacent the inside edge 35 of the top seam 23.

In another embodiment, the barrier material 50 is partially disposed within the seals 21, 22, 23, but does not extend to the outside edges 17, 27, 29 of the panels 10, 20 (shown in FIG. 2). Regardless of whether the barrier material 50 is partially disposed within the seals or not, it is essential that the barrier material 50 is not disposed adjacent a cut edge 17, 27, 29 of the packaging structure.

By providing a packaging structure wherein the barrier material 50 is disposed on the interior of the packaging but the packaging is barrier-free within the heat seals and/or adjacent any cut edges, the barrier material itself is not exposed to the water and moisture involved in retort, pasteurization, boiling, and the like. As a result, the barrier material 50 does not break down and cause the seals to fail. If the barrier material 50 were disposed adjacent an exposed edge 17, 27, 29, the heat/moisture would likely break down the barrier material and cause the seal to fail.

While the seams herein are discussed as being heat seals, it should be understood that any seam or seal which creates a permanent adhesion between two panels and can be successfully subjected to pasteurization, retort, hot fill, boiling, or the like, may be utilized. Thus, in some cases, the seams may be sealed via a cold seal or using any permanent adhesive known in the art.

In some cases, the packages may be gusseted to form stand-up pouches. Thus, a base panel may be connected to base ends of the respective front and back panels to form the base of the stand-up pouch. In such cases, the barrier material 50 may be disposed on the interior of the front panel, back panel, and base, but the packaging structure may be barrier-free in any seams and/or in any exposed edges between the various panels which may be exposed to pasteurization, retort, hot fill, boiling, or the like.

In further embodiments, the package may comprise a flexible film which is configured cylindrically, has a fin seal, and is end sealed on each side of the cylindrical shape. In such cases, the barrier material 50 may be disposed on the interior of the cylindrical panel, but the packaging structure may be barrier-free in any seams and/or in any exposed edges which join the edges of the panel, such as the fin seal or the end seals.

In an embodiment, a consumer may open the package by separating the front and back panels 10, 20 via peeling of the top seam 23, by opening a closure feature (e.g., a zipper or tongue-and-groove mechanism), by separating or cutting off a seal provided at one of the ends, via a fitment, and/or via any other mechanism known in the art.

The packaging structure may comprise any material known in the art. In an embodiment, the packaging material comprises a single polymer, such that it may be easily recycled. In an embodiment, the packaging material may comprise polyethylene (PE) or polypropylene (PP). In an embodiments, the packaging material may comprise polyethylene terephthalate, low density polyethylene, medium density polyethylene, high density polyethylene, linear low density polyethylene, oriented PE or PP, or any other flexible polymeric material known in the art.

In an embodiment, a method is provided. In one embodiment, the method may comprise providing a first panel defining a first end, a second end opposite the first end, and at least two side edges and providing a second panel defining a first end, a second end opposite the first end, and at least two side edges. Longitudinal seam areas may be designated along respective side edges of the first and second panel. Similarly, at least one end seam area may be designated along an outer edge of at least one of the first end or the second end of the first and second panels. The interior surface of at least one of the first and second panels may be then coated with a barrier material, wherein the barrier coating does not extend to the side edges of the longitudinal seams or to the outer edge of the at least one end seam. In an embodiment, a heat-seal material is pattern applied to the longitudinal seam areas and the at least one end seam area. In another embodiment, the first and second panels comprise a polymer material with a wide melt temperature range and can be melt-sealed to itself. In an embodiment, the first and second panels may then be sealed to form longitudinal seams in the longitudinal seam areas and to form at least one end seam in the at least one end seam area.

In an embodiment, the barrier coating and/or heat seal material can be applied via methods such as Gravure or flexographic printing, or any other method known in the art. In an embodiment, the barrier coating extends partially into at least one of the longitudinal seam areas and the at least one end seam area. In another embodiment, the barrier coating does not extend into the longitudinal seam areas or the at least one end seam area. In an embodiment, the method additionally comprises a folding step before the sealing steps, wherein the first and second panels comprise a single sheet and are folded such that the side edges of the longitudinal seams align and the outer edge of the end seam for each panel aligns. In other embodiments, the first and second panels are separate panels and are sealed along all four sides during the sealing steps. In still other embodiments, a base panel is disposed between and is sealed to at least a portion of the first and second panels.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A package comprising:

a first panel defining a first end, a second end opposite the first end, and at least two side edges;

a second panel defining a first end, a second end opposite the first end, and at least two side edges, wherein the second panel is connected to the first panel via longitudinal seams formed along respective side edges of the first and second panels; and at least one end seam formed along at least one of the first end and the second end of the first and second panels, wherein the at least one end seam comprises an outer edge; and a barrier coating disposed on an interior surface of at least one of the first and second panels, wherein the barrier coating extends partially into at least one of the longitudinal seams and the at least one end seam and wherein the barrier coating does not extend to the side edges of the longitudinal seams or the outer edge of the at least one end seam.

2. The package of claim 1 wherein the first panel and the second panel each comprise a single sheet which is folded to form the package.

3. The package of claim 1 comprising two end seams, the first end seam disposed along the first end of the first and second panels and the second end seam disposed along the second end of the first and second panels.

4. The package of claim 1 additionally comprising a base panel which is connected to the first and second panels.

5. The package of claim 1, wherein the first panel and the second panel each comprise the same material.

6. The package of claim 5, wherein the first and second panel comprise a mono-polymeric material.

7. The package of claim 1 wherein the longitudinal seams and end seam comprise heat seals.

8. The package of claim 1, wherein the barrier material comprises polyvinyl alcohol.

9. A package comprising:

a first panel defining a first end, a second end opposite the first end, and at least two side edges;

a second panel defining a first end, a second end opposite the first end, and at least two side edges, wherein the second panel is connected to the first panel via longitudinal seams formed along respective side edges of the first and second panels; and at least one end seam formed along at least one of the first end and the second end of the first and second panels, wherein the at least one end seam comprises an outer edge; and a barrier coating disposed on an interior surface of at least one of the first and second panels, wherein the barrier coating extends partially into at least one of the longitudinal seams and the at least one end seam and wherein the package is barrier-free adjacent at least the side edges of the longitudinal seams and the outer edge of the at least one end seam.

10. The package of claim 9 further comprising a base panel connecting at least part of the first panel to the second panel, such that the package is a stand-up pouch.

11. A method of manufacturing a package comprising:

providing a first panel defining a first end, a second end opposite the first end, and at least two side edges;

providing a second panel defining a first end, a second end opposite the first end, and at least two side edges;

designating longitudinal seam areas along respective side edges of the first and second panel;

designating at least one end seam area along an outer edge of at least one of the first end or the second end of the first and second panels;

coating a barrier material onto on an interior surface of at least one of the first and second panels, wherein the barrier coating extends partially into at least one of the longitudinal seams and the at least one end seam and does not extend to the side edges of the longitudinal seams or to the outer edge of the at least one end seam;

sealing the first and second panels to form longitudinal seams in the longitudinal seam areas; and sealing first and second panels to form at least one end seam in the at least one end seam area.

12. The method of claim 11, additionally comprising a folding step before the sealing steps, wherein the first and second panels comprise a single sheet and are folded such that the side edges of the longitudinal seams align and the outer edge of the end seam for each panel aligns.

13. The method of claim 11, additionally comprising pattern application of a heat-seal material to the longitudinal seam areas and the at least one end seam area.

14. The method of claim 11, wherein the first and second panels comprise a polymer material which can be melt-sealed to itself.

* * * * *